United States Patent [19]

Prince

[11] 4,384,369

[45] May 24, 1983

[54] EXERCISE SUIT

[76] Inventor: Lyndonn Prince, 644 Riverside Dr., Apt. 3E, New York, N.Y. 10031

[21] Appl. No.: 262,480

[22] Filed: May 11, 1981

[51] Int. Cl.[3] ..... A41D 13/02

[52] U.S. Cl. ..... 2/79; 2/81; 2/227; 2/93; 128/80 G; 272/119

[58] Field of Search ..... 2/69, 81, 74, 79, 227, 2/93, 94; 272/119; 128/80 G

[56] References Cited

U.S. PATENT DOCUMENTS

| | | | |
|---|---|---|---|
| 3,296,819 | 1/1967 | Gough | 2/81 X |
| 3,643,463 | 2/1972 | Friedlander et al. | 2/81 X |
| 3,950,789 | 4/1976 | Konz et al. | 2/81 X |
| 4,303,239 | 12/1981 | Walsh, Jr. | 272/119 |
| 4,310,926 | 1/1982 | Maroist | 2/81 |

*Primary Examiner*—H. Hampton Hunter
*Attorney, Agent, or Firm*—Natter & Natter

[57] ABSTRACT

An exercise suit includes a jacket and pants having numerous pockets. The pockets carry bags containing liquid to provide a weight load and massaging muscle stimulation during body movement. The pockets are so distributed about the user's body as to provide dynamic contact with externally exposed muscles. The bags are configured to be received within corresponding pockets of the suit and are formed of vinyl panels with dielectrically welded seams. A closure is provided to permit the user to fill each bag with a desired quantity of liquid, and the outer panel of each bag includes an insulating foam layer. To permit automatic adjustment for different body sizes, the sleeves and legs of the suit are longitudinally slit and an elastic strap draws the opposite edges of each slit toward one another thus maintaining the suit and its dynamic load in proximate contact with the user's limbs.

10 Claims, 10 Drawing Figures

FIG. 1
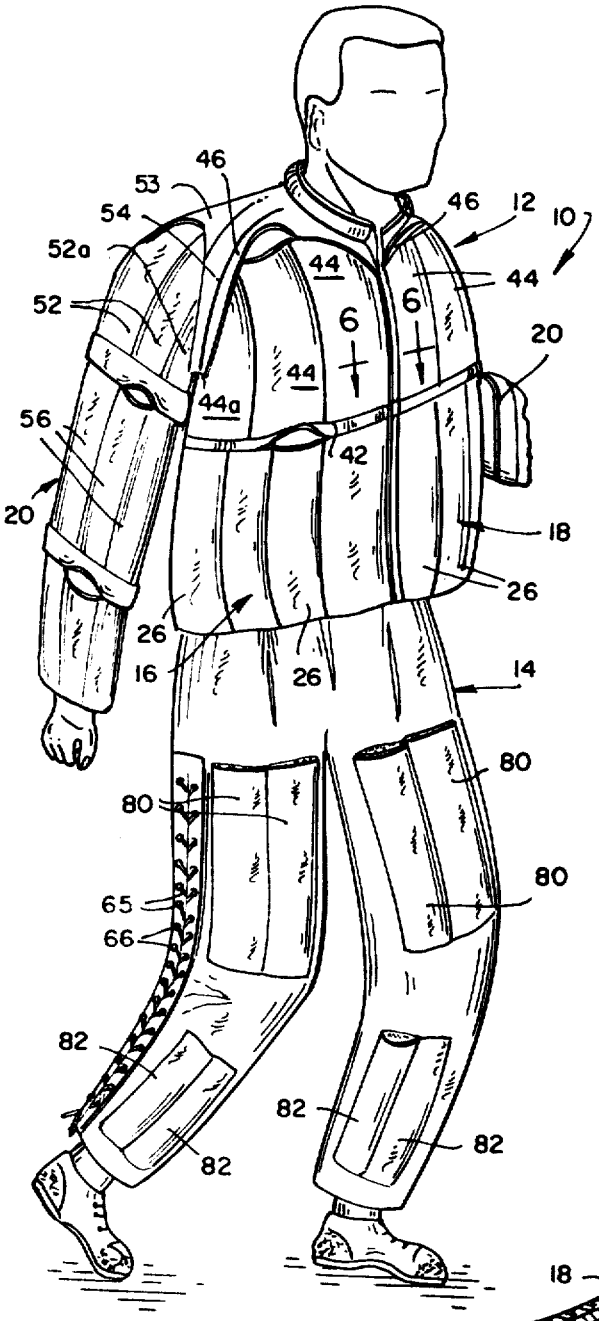
FIG. 4
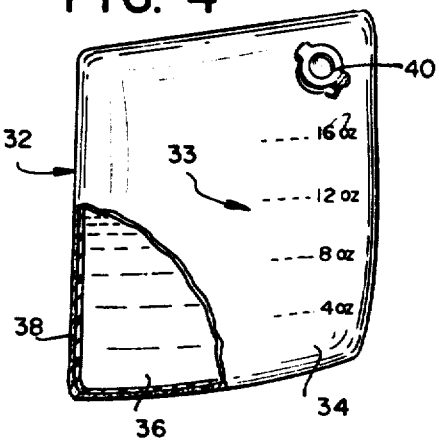
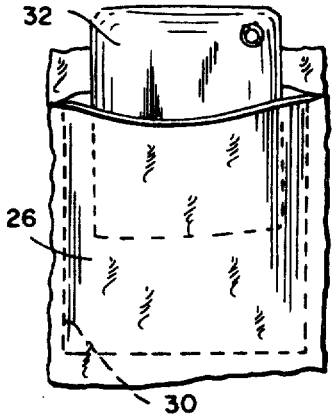
FIG. 5
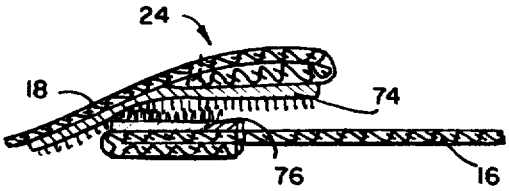
FIG. 6

EXERCISE SUIT

BACKGROUND OF THE INVENTION

1. Field of the Invention

The invention relates generally to exercise materials worn about a user's body and more specifically to an exertics suit which carries a dynamic load.

2. Brief Description of the Prior Art

Increased stamina, strength and muscle development have been the primary goals of athletes through the ages.

Countless devices have been proposed for assisting athletes in the improvement of their strength, stamina and skills. Some devices have been employed for excerising particular muscles or muscle groups, and several of these devices have been proposed to be mounted to the user's body. Among such excercising apparatus were the familiar ankle weights. A proposed apparatus shown in U.S. Pat. No. 4,180,261 for mounting weights to an athlete's body was attached to the front of the user's thigh.

In U.S. Pat. No. 3,759,510 a composite exercise garment included a plurality of compartments which were loaded with a particulate weighting material such as sand, leadshot, steelshot or sawdust. The weight carried in the pockets represented a static rather than a dynamic type load which settled in each pocket and tended to interfere with the movements or balance of the user. In addition, it was cumbersome to change the weight amount carried in each pocket.

SUMMARY OF THE INVENTION

An exercise suit having a jacket and pants is constructed with numerous pockets spaced about its periphery in conformity with various anatomic muscle formations. The pockets carry bags containing liquid to provide a dynamic muscle conforming inertial massaging force during body movement, as well as an exercise load for muscle development.

The liquid carrying bags are formed of two layers of polyvinyl chloride sealed along the mating peripheries with one of the layers having a closure for adding a desired quantity of liquid. To provide thermal insulation, thereby retarding heat loss during outdoor exercising in cold weather, the outer panel of each bag includes a layer of insulating material such as a closed cell vinyl foam.

To provide an adjustable fit for varying sizes, the limb segments are longitudinally slit and elastic straps draw opposed edges together. As such, the suit with its weight load is kept against the body's muscle formations. The jacket is adjustably closed with a strip hook and loop type fastener.

From the foregoing compendium, it will be appreciated that it is an object of the present invention to provide an exercise suit of the general character described which is not subject to the disadvantages of the prior art as aforementioned.

A further object of the present invention is to provide an exercise suit of the general character described which provides a variable exercise weight load evenly distributed about the user's body.

A still further object of the present invention is to provide an exercise suit of the general character described which provides a dynamic weight load for massaging various muscular areas.

Another object of the present invention is to provide an exercise suit of the genreal character described which is adjustable for various sizes and maintains a dynamic weight load in proximate relationship to anatomic muscle groups.

Yet another object of the present invention is to provide an exercise suit of the general character described which retards body heat loss in cold weather.

A further object of the present invention is to provide an exercise suit of the general character described which includes a plurality of pockets carrying weight bags with the weight of each bag being easily varied.

Another object of the present invention is to provide an exercise suit of the general character described which is well suited for economical mass fabrication techniques.

A further object of the present invention is to provide an exercise suit of the general character described having a plurality of pockets anatomically configured about the user's body with each pocket carrying a bag containing a liquid.

Other objects of the present invention in part will be obvious and in part will be pointed out hereinafter.

With these ends in view, the invention finds embodiment in various combinations of elements and arrangements of parts by which the said objects and certain other objects are hereinafter attained, all with reference to the accompanying drawings and the scope of which is more particularly pointed out and indicated in the appended claims.

BRIEF DESCRIPTION OF THE DRAWINGS

In the accompanying drawings in which is shown one of the various possible exemplary embodiments of the invention:

FIG. 1 is a pictorial depiction of an athlete wearing an exercise suit constructed in accordance with and embodying the present invention;

FIG. 4 is an exemplary view of a liquid containing bag which is selectively received within an associated pocket of the suit and and with portions of the bag cut away to better illustrate the bag's construction and contents;

FIG. 5 is a fragmentary front elevational view of a portion of the suit, drawn to an enlarged scale, and illustrating a bag being positioned within a pocket;

FIG. 6 is an enlarged scale fragmentary sectional view through the front of the jacket, the same being taken substantially along the line 6—6 of FIG. 1 and illustrating a hook and loop type adjustable fastener;

DESCRIPTION OF THE PREFERRED EMBODIMENT

Figure 2:
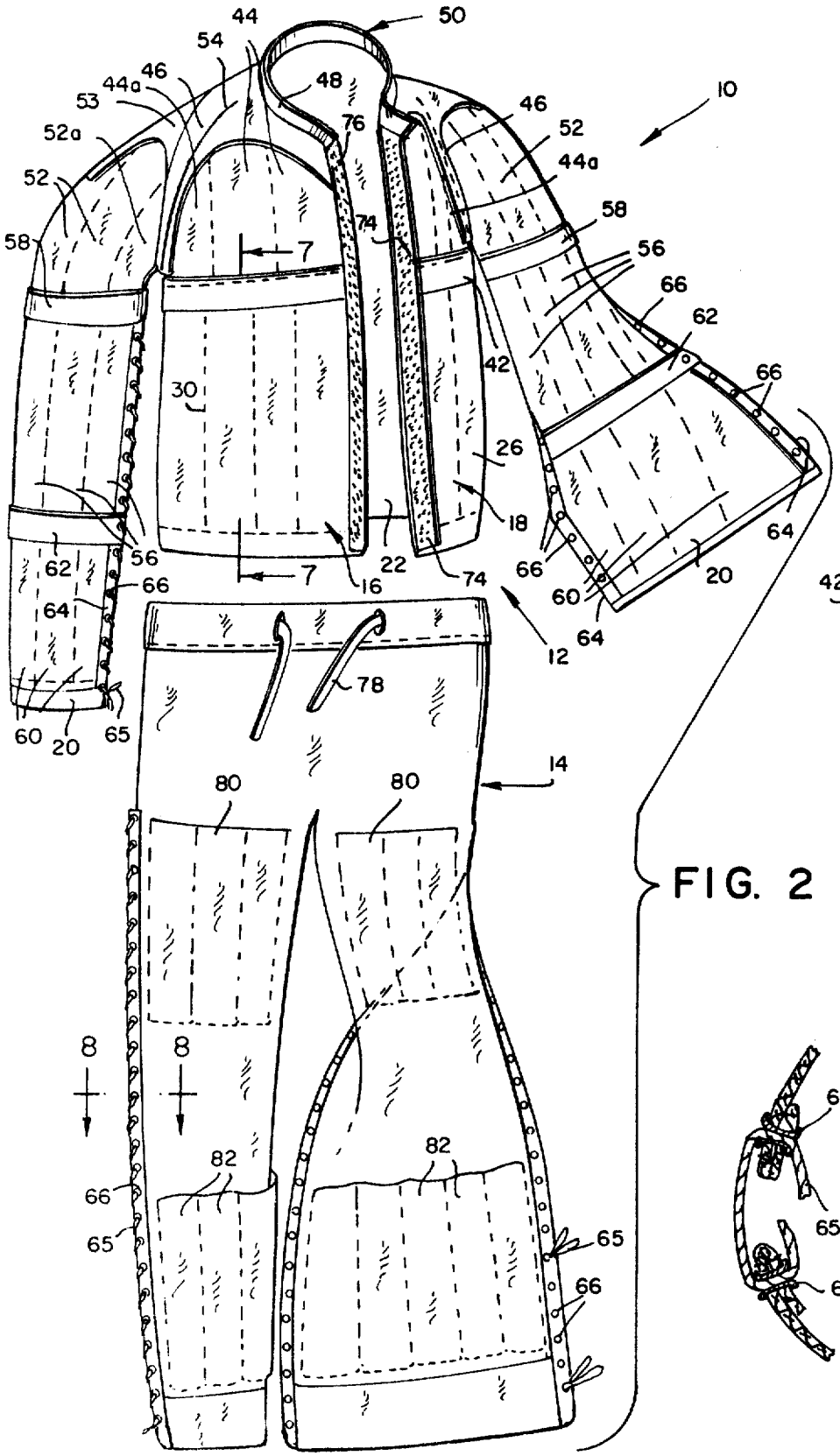
FIG. 2 is a front elevational view of the jacket and pants of the exercise suit with a sleeve and a leg portion being opened to further illustrate the construction of the suit.

Referring now in detail to the drawings, the reference numeral 10 denotes generally an exercise suit constructed in accordance with and embodying the present invention. The suit 10 includes a jacket 12 and pants 14.

Pursuant to the present invention a plurality of pockets are anatomically arrayed about the suit 10 for the purpose of positioning bags carrying a liquid weight in proximate contact with variour muscle groups of the user. Thereby, the suit 10 provides an exercise weight load and yieldable muscle engaging massaging forces created by body movements of the user which vary the inertia of the mass carried by the bags.

The jacket may be fabricated of any suitable durable fabric material such as Rip Stop nylon, as well as conventional synthetic and/or natural woven fibrous material. Film materials may also be employed. The jacket includes a right and a left front panel 16, 18, respectively, a pair of sleeves 20 and a rear panel 22.

Figure 7:
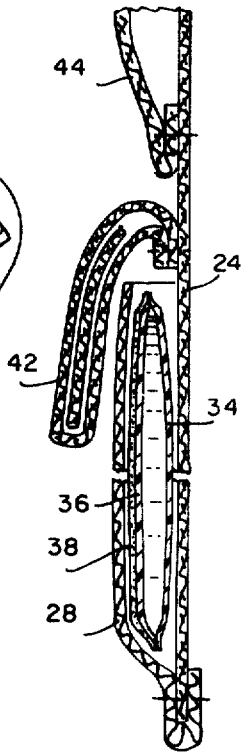
FIG. 7 is an enlarged scale fragmentary longitudinal sectional view through the front of the jacket, the same being taken substantially along the line 7—7 of FIG. 2 and illustrating a pocket formed in the front of the jacket, a typical bag received in the pocket and an integral closure flap for the pocket formed as a band extending across the front of the jacket.
Figure 8:
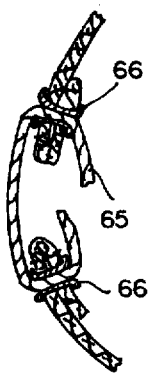
FIG. 8 is an enlarged scale transverse fragmentary sectional view through a leg, the same being taken substantially along the line 8—8 of FIG. 2 and illustrating opposite edges of a longitudinal slick being drawn together by an elastic band.

Referring now to FIGS. 1, 2 and 7, the jacket 12 is formed of a layer or shell 24 of the fabric material. At the lower portion of the front panel, a group of longitudinal pockets 26 are provided for corresponding with the muscular areas of the user in proximate relation thereto, e.g. the rectus abdominus and the external oblique. The pocket 26 is formed of an outer layer 28 of fabric material sewn to the shell 24 along various seamlines 30, which seamlines define the individual pockets. The seamline 30 provides side walls and a bottom wall with the top of the outer layer 28 being free for access to the pocket and insertion of a correspondingly configured liquid carrying bag 32.

In FIG. 4, a typical bag 32 is illustrated. The bag 32 includes an inner wall 34 (adapted to be facing the user) and an outer wall 36 (adapted to face away from the user). The outer wall 36 includes a laminated layer of foam insulating material 38 bonded thereto or formed integral therewith. The inner and outer walls 34, 36 may be formed of sheets of a suitable thermoplastic material and with the peripheral edges being formed as dielectrically welded seams, for example. Suitable materials of which the bag 32 may be constructed include polyvinyl chloride with the foam insulating material 38 constituting a closed cell vinyl foam.

It should be additionally noted that a closure 40 is provided in one of the walls, as illustrated in FIG. 4. The closure 40 is shown as being positioned on the inner wall, however this is merely an exemplary illustration. Closure suitable for incorporation with the bags 32 are readily available components, such as the Roberts closure 650-AD Series available from Halkey-Roberts Corp. of St. Petersburg, Florida. The closure 40 permits access to the interior of the bag 32 for the purpose of filling the bag to a suitable level with a liquid such as ordinary tap water. Naturally, the weight of each bag will be dependent upon the volume of liquid material carried. For the purpose of gauging the weight of each bag, index of weight or volume increments 33 are provided on one of the walls.

Figure 3:
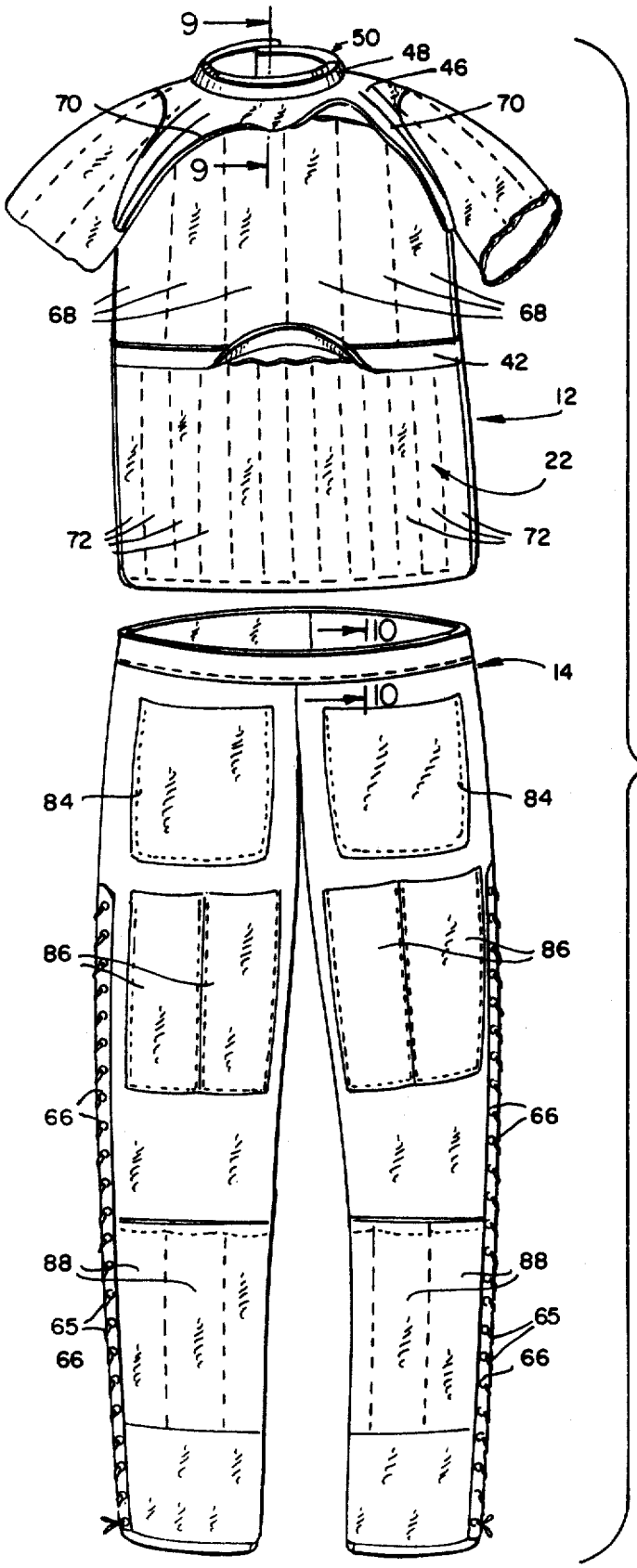
FIG. 3 is a rear elevational view of the jacket and pants showing flaps which form closures for pockets in an open position to expose the mouths of selected pockets.
Figure 9:
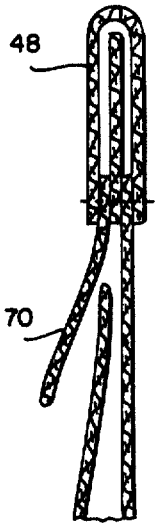
FIG. 9 is an enlarged scale fragmentary longitudinal sectional view through the rear panel of the jacket, the same being taken substantially along the line 9—9 of FIG. 3 and illustrating a further flap which provides a pocket closure.
Figure 10:
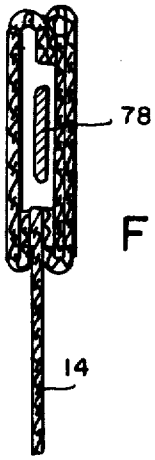
FIG. 10 is an enlarged scale fragmentary longitudinal sectional view through the rear of the pants, the same being taken substantially along the line 10—10 of FIG. 3 and illustrating a draw web which is provided as a waistband for supporting the pants about the user.

From an examination of FIGS. 1, 2 and 3, it will be seen that a decorative band 42 is provided horizontally across the right and left front panels 16, 18, as well as the rear panel 22. The band 42 is positioned above the mouth of the pocket 26 and is sewn to the fabric shell 24 so as to provide an overhanging flap, thereby selectively closing the pockets 26. A portion of the band 42 is twisted to an open position in FIG. 1 for the purpose of exposing one of the pockets 26.

Above the band 42, the front panels 16, 18, a further group or unit of pockets 44 are positioned in proximate relationship to the pectoralis major muscles. The pockets 42 are constructed in a manner similar to the construction of the pockets 26 and are formed of an outer layer of suitable material such as fabric sewn to the shell 24.

Access to the mouths if the pockets 44 is provided by a closure flap 46 which simulates a raglan sleeve binding in appearance. The flap 46 is formed of a layer of fabric material which is secured to the jacket 12 along its upper edge within a binding 48 forming a part of the jacket collar 50.

It should be noted that the group of pockets 44 are of different configuration than the pockets 26 (being generally shorter and wider). The bags 32 which are inserted into such pockets will naturally be of a conforming shape.

With respect to the jacket sleeves 20, such sleeves include a group of shoulder pockets 52 formed of an outer layer of suitable material sewn to the shell 24. The pockets 52 are configured and positioned to coincide with the muscle at the user's shoulder, i.e. the deltoid. The mouths of the pockets 52 are selectively closed by a web 53 of the flap 46. The flap 46 is sewn along its longitudinal center to the shell 24 by a seam 54 thereby providing a pair of closure lips for a pair of adjacent pockets **44*a* and 52*a*. The lips may be secured to the adjacent pockets 44*a*, 52*a*** by a suitable fastener.

A further array of sleeve pockets 56 is provided beneath the pockets 52. The group of pockets 56 are formed of an outer layer of suitable material sewn to the shell 24. They are positioned so as to present the bags of liquid carried therein to be in proximate relationship to the muscle groups of the upper arm such as the triceps, the biceps brachi, and the brachialis.

A band 58 similar in construction to the band 42 which extends across the front and rear panels of the jacket is positioned in circumscribing relationship about each sleeve 20 to provide a closure for the mouths of the pockets 56. The band 58 is desirably positioned at the same elevation as the band 42 to present the appearance of a continuous horizontal stripe across the front and sleeves.

A further group of sleeve pockets 60 are positioned beneath the upper arm pockets 56. The pockets 60 are also formed of an outer layer of suitable material with a plurality of sewn seams defining each individual pocket. The pockets 60 are positioned so as to place liquid carrying bags contained therein in proximate contact with the muscle groups of the forearm, e.g. brachioradialis, flexor capri radialis, palmaris longus, abductor pollicis longus, extensor pollicis longus, flexor capri ulnaris, etc. A flap is provided for selective closing of the open mouths of the pockets 60 by a band 62 which circumscribes the sleeve 20 and is similar in construction to the band 58.

In order to provide for adjustment of the sleeve 20 to assure proximate contact between the liquid carrying bags and the various arm muscle groups, each sleeve 20 is provided with the longitudinal slit defined by a pair of opposed edges 64 having a plurality of grommets 66. An elastic strap is laced between the grommets in conventional fashion to draw the edges 64 toward one another. The elastic strap will assure that the sleeve fits snugly against the user's arm.

Turning now to the back of the jacket as shown in FIG. 3, the rear panel 22 includes a group or unit of upper pockets 68 positioned so as to place liquid carrying bags 32 contained therein in proximate contact with the muscles of the upper back, e.g. the trapezius. The pockets 68 are formed of an outer layer of suitable material sewn to the shell 24 in a manner similar to the construction of the pockets previously described. Access to the mouths of the pockets 68 is provided by a closure flap 70 similar in construction to the closure flap 46. Beneath the pockets 68 a further array of pockets 72 is provided for positioning further bags 32 in proximate relationship to muscle groups of the lower bag such as the latissimus dorsi. The unit or group of lower back pockets 72 are formed of an outer layer of suitable material sewn to the shell 24. The band 42 which circumscribes the jacket 12 provides a flap for selectively closing the mouths of the pockets 72.

In order to adjustably fit the jacket about the user, a hook and loop type strip fastener such as Velcro fastener is provided. Such fasteners generally comprise a strip of hook elements 74 and a mating strip of loop elements 76. One strip, e.g. the hook element strip 74, is secured to the inside of the jacket shell 24 corresponding with the longitudinal edge of the left front panel. The other strip 76 extends along the outer longitudinal edge of the right front panel 18. To snugly fit the jacket 12, the user need only overlap the left front panel longitudinal edge over the right front panel and press the wide strip 74 against the narrow strip 76.

The pants 14 of the exercise suit 10 includes a draw web or belt 78 at the waist and arrays of pocket units anatomically positioned to provide proximate contact between liquid carrying bags 32 and various muscle groups of the lower portion of the user's body. At the front of the pants 14, a group or unit of pockets 80 are provided for positioning liquid carrying bags 32 in proximate contact with the muscles at the user's thigh such as the rectus femoris, the vastus medialis, and the vastus lateralis. The pockets 80 are formed in a manner similar to the pockets previously described and include an outer layer of fabric or the like stitched to the front of each pants leg. An alternate closure may be provided for the pockets 80 in the form of a Velcro fastener sewn to the pants leg shell in registration with a mating Velcro fastener formed in the pocket material. A similar Velcro fastener may be employed to maintain the sleeve flaps 46 over the pockets **52*a* and 44*a***.

Beneath the pockets 80, a further group or unit of pockets 82 is provided on each pants leg. The pockets 82 are similarly formed of an outer layer of material sewn to the shell of the pants leg and include, in an exemplary manner, a velcro fastener for providing a closure. The unit of pockets 82 is configured and positioned as to present the liquid carrying bags 32 in proximate relationship to the muscles of the user's shin area such as the soleus, the extensor digitorum longus, the peroneus longus, the gastrocnemius, the anterior tibial, and the peroneus longus.

Turning now to the rear of the pants 14, a unit comprising a pair of pockets 84 is provided above the top of the pants legs. Each pocket 84 carries a relatively large bag 32 in proximate contact with the user's gluteus maximus. The pockets 84 are formed of an outer fabric or sheet material layer suitably secured to the shell of the pants. Beneath the pockets 84 each leg includes a further group or unit of pockets 86 of similar construction but different shape. Each of the pockets 86 is somewhat longer and narrower than the pockets 84 with the pockets 86 configured and positioned to place the liquid carrying bags 32 carried therein in proximate contact with the biceps femoris, the semitendinosus and the semimembranosus muscle groups.

A further plurality of pockets 88 are provided on each leg beneath and spaced from the pockets 86. The pockets 88 are of similar construction yet are configured and positioned to place liquid carrying bags 32 in proximate physical contact with muscle areas such as the gastrocnemius and soleus.

It should be appreciated that any suitable liquid may be employed to fill or partially fill any or all of the bags 32. The quantity of liquid employed will be dependent upon the desired weight load for the particular area of the body against which the suit 10 places the individual bag. The weight load of each bag 32 may be varied also by varying the liquid carried to liquids having different specific gravities.

The filled or partially filled bags 32 constitute a mass for generation of lateral massaging forces due to changes in the inertia of the mass during exercise movement of the user. A massaging effect is achieved because the lateral forces vary due to the changeable shape of the liquid.

To provide for adjustment of the pants legs for assurance of proximate contact with the liquid carrying bag units and the lower body muscle groups, each leg is slit and opposite edges are drawn together by an elastic strap 65 which is laced between a plurality of grommets 66.

It should be appreciated that the exercise suit 10 is well suited for both warm and cool climatic conditions. In warm climatic conditions, the liquid carried in the bags will absorb body heat generated during exercising and thus tend to maintain the user's body temperature at desirable levels without undue perspiration. In cold weather, the liquid within the bags will desirably be at room temperature prior to outdoor exercising.

The bags 32 are so constructed as to permit outdoor exercising without any additional or further outerwear. For this purpose, the outer surface of each bag adjacent its outer wall 36 includes the foam layer 38 which retards heat loss to the atmosphere. The rate of heat generation by the user's body during exercise will be sufficient to maintain the water temperature for substantial durations in cold weather.

Various modifications to the exercise suit shown will be readily apparent to those of skill in the art. For example, the suit may be constructed as a one piece jump suit or as a two piece suit with a pullover top. Further modifications from the exemplary embodiment shown might contemplate alternate fasteners such as slide fasteners or the elmination of the slits and elastic draw straps in the sleeves and legs and alternate pocket constructions, all without departing from the spirit of the invention.

Thus, it will be seen that there is provided an exercise suit of the general character described which achieves the various objects of the present invention and which is well adapted to meet the conditions of practical use.

As various changes might be made in the exercise suit as above set forth, it is to be understood that all matter herein described or shown in the accompanying drawings is to be interpreted as illustrative and not in a limiting sense.

Having thus described the invention, there is claimed as new and desired to be secured by Letters Patent:

1. An exercise suit comprising a shell adapted to cover a majority of the externally accessible muscle groups of a wearer, means forming a plurality of units of pockets on the shell, each unit comprising at least one pocket in registration with a particular muscle area of the wearer, each pocket including a mouth, liquid carrying bags insertable into and removable from each pocket through the mouth, the liquid carrying bags providing a weight load to be borne by the wearer and a dynamically yieldable muscle stimulating force during body movement of the wearer.

2. An exercise suit constructed in accordance with claim 1 wherein the shell includes means for covering the chest, back and legs of the user, the suit including pants.

3. An exercise suit constructed in accordance with claim 1 further including means for selectively closing the mouths of the pockets, the closing means comprising means forming the flap overlying the mouth of the pocket, and means securing at least a portion of the flap to the shell.

4. An exercise suit constructed in accordance with claim 3 wherein the flap comprises a band secured to the shell.

5. An exercise suit constructed in accordance with claim 1 further including means for maintaining the bags in proximate contact with the muscles registered with their respective pockets, the maintaining means comprising adjustable means for fitting the shell against the body of the wearer.

6. An exercise suit constructed in accorcance with claim 5 wherein the adjustable means includes elastic securing means.

7. An exercise suit constructed in accordance with claim 1 wherein the liquid carrying bags comprise a pair of vinyl panels seamed along their peripheries.

8. An exercise suit constructed in accordance with claim 7 wherein one of the bag panels includes an insulating layer of foam material.

9. An exercise suit constructed in accordance with claim 7 wherein each bag includes closure means for accessing the interior, the liquid carried by each bag being selectively increased or decreased through the closure.

10. An exercise suit constructed in accordance with claim 1 further including means for selectively closing the mouths of the pockets, the closing means comprising hook and loop fasteners.

* * * * *